United States Patent [19]

Tratar et al.

[11] Patent Number: 4,898,538

[45] Date of Patent: Feb. 6, 1990

[54] SELF ALIGNING CONNECTOR

[75] Inventors: Michael F. Tratar, Mentor; Edwin L. Bremenour, Euclid; Dale R. Terdan, Mentor, all of Ohio

[73] Assignee: Allen-Bradley Company, Inc., Milwaukee, Wis.

[21] Appl. No.: 310,951

[22] Filed: Feb. 16, 1989

[51] Int. Cl.[4] ..... H01R 13/629

[52] U.S. Cl. ..... 439/76; 439/374; 439/378; 29/464

[58] Field of Search ..... 439/246–248, 439/252, 374, 378, 76; 29/464, 467, 468

[56] References Cited

U.S. PATENT DOCUMENTS

| | | | |
|---|---|---|---|
| 3,116,959 | 1/1964 | Abodeely . | |
| 3,546,659 | 12/1970 | Powers . | |
| 4,217,624 | 8/1980 | Tuck | 361/394 |
| 4,227,238 | 10/1980 | Saito | 361/415 |
| 4,472,609 | 9/1984 | Lamm et al. | 200/5 |
| 4,509,258 | 4/1985 | Locati et al. | 439/378 |
| 4,572,602 | 2/1986 | Rupnik | 339/65 |
| 4,580,858 | 4/1986 | Daberkoe | 339/17 |
| 4,682,833 | 7/1987 | Ferchau et al. | 439/377 |
| 4,690,471 | 9/1987 | Marabotto et al. | 439/246 |
| 4,746,304 | 5/1988 | Asai | 439/248 |

FOREIGN PATENT DOCUMENTS

| | | | |
|---|---|---|---|
| 48085 | 3/1982 | European Pat. Off. | 439/374 |

*Primary Examiner*—Gary F. Paumen
*Attorney, Agent, or Firm*—Quarles & Brady

[57] ABSTRACT

A connector assembly uses an intermediate guide plate to align and mate opposing connectors mounted on electrical chassis. The intermediate plate includes guide pins and is aligned to the first chassis by means of an alignment fixture attaching between the guide pins and the first connector. The guide plate is attached to the first chassis and the alignment fixture is removed, the guide pins allowing alignment with the second chassis and connector.

8 Claims, 3 Drawing Sheets

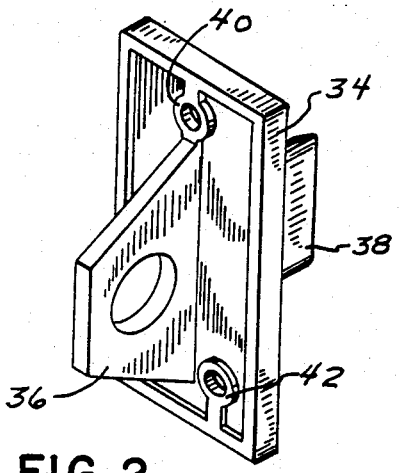
FIG. 2
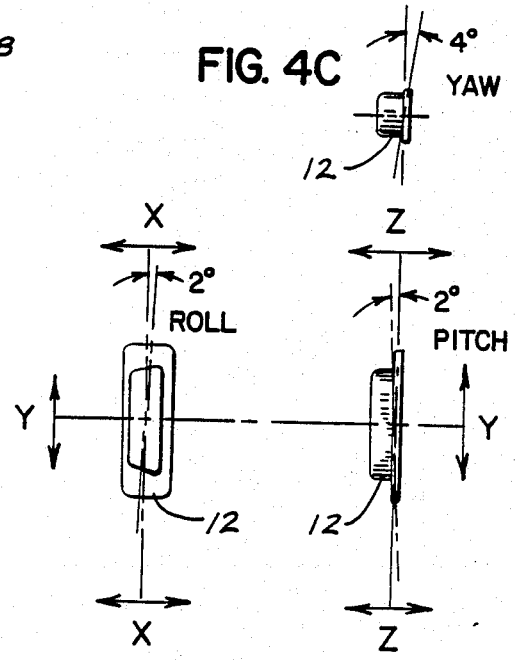
FIG. 4C
FIG. 4A
FIG. 4B
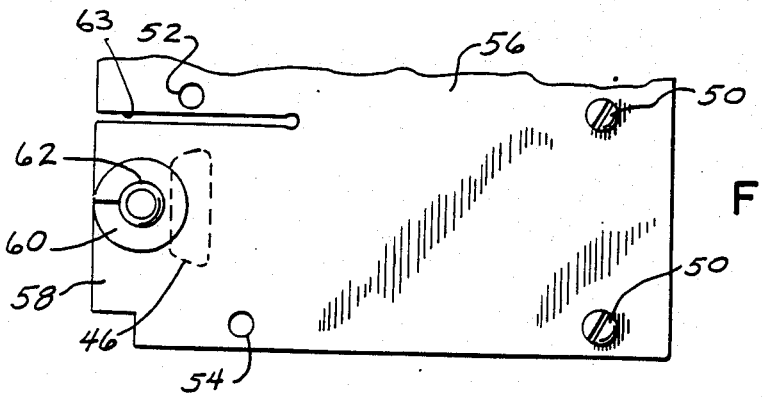
FIG. 5

SELF ALIGNING CONNECTOR

This invention relates to an alignment system for connectors mounted on mating chassis. More particularly, the present invention relates to a self aligning system that will accommodate misalignment of one connector with respect to its chassis.

Considerations of manufacturing convenience and the desire to improve product flexibility through modular construction has created the need to electrically connect electronic subassemblies located in separate enclosures. One method of accomplishing this task is through the use of a flexible cable with connectors at each end which mate with connectors on the chassis. Mating alignment of the connectors is accomplished visually.

The use of cabling adds cost to the manufacturing process and may reduce reliability. Therefore it is desirable to attach the chassis connectors directly to each other. This approach eliminates cabling costs and associated reliability problems, but may prevent ready assembly in situations where the chassis obstruct the view of the connectors and therefore prevent visual alignment.

Guiding devices affixed to the chassis can be used to permit blind assembly of the connection devices in such situations, but suffer from the drawback of requiring exacting manufacturing tolerances in the alignment of the connectors with respect to the chassis to which such guiding devices are attached.

SUMMARY OF THE INVENTION

A general object of the invention, therefore, is to permit the blind connection of electronic subassemblies without the need for precise tolerances in the location of one connector half with respect to its chassis. An intermediate guide plate incorporating alignment pins is oriented onto one chassis with respect to that chassis' connector by means of an alignment fixture. The guide plate is then affixed to the chassis and the alignment fixture removed, permitting the chassis and its connector to be assembled to a second chassis and connector by means of the alignment pins.

It is another object of the invention to accommodate axial connector misalignment. The receiving connector is directly mounted to a printed circuit board which has one end cantilevered to provide flexure and the other end supported by a spring-loaded plunger. This flexibility prevents over-travel damage to the connector in the event that the opposing connector is displaced toward it, with respect to its enclosure.

It is a further object of this invention to permit the interconnection of many combinations of enclosures of varying physical dimensions. The intermediate guide plate is separate from either connector and therefore may be substituted with a different version depending on the particular enclosures to be connected.

It is another object of this invention to permit the use of standard electrical connectors in a self-aligning configuration. The use of the alignment guide and the intermediate alignment plate provide the necessary alignment means for a standard electrical connector.

It is another object of the invention to permit the connectors to be mounted directly on the printed circuit cards avoiding the need for attaching individual wires; thereby improving manufacturing efficiency and reliability of the completed unit. A slot cut in one circuit card allows the flexibility necessary to ensure reliable mating of the connectors. A spring-loaded plunger provides added controllable stiffness.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DESCRIPTION OF THE DRAWINGS

FIG. 2 is a perspective view of a fixture employed in assembling the alignment system components.

FIGS. 4 A, B and C are three views of a standard electrical connector showing the modes of misalignment.

FIG. 5 is a partial plan view of the circuit board of FIG. 1.

DESCRIPTION OF THE PREFERRED EMBODIMENT

Figure 1D:
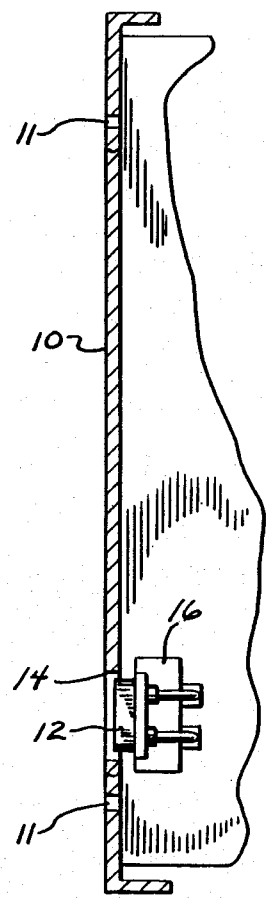
FIG. 1 is an exploded view of the alignment system of the present invention.
Figure 1C:
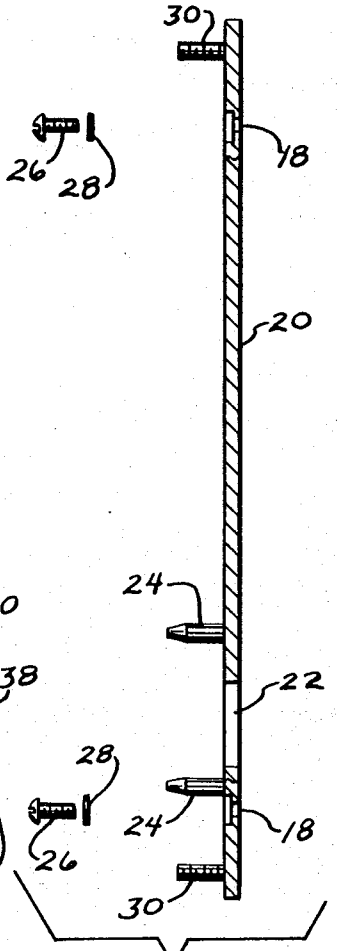
Figure 1B:
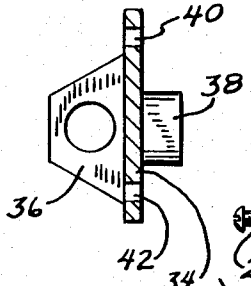
Figure 1A:
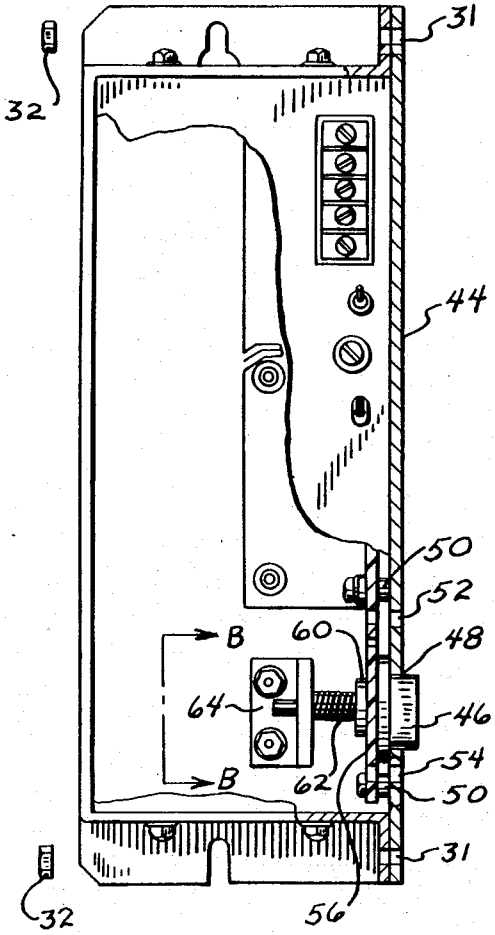

Referring to FIG. 1, a first enclosure 10 is shown prior to its assembly with a second enclosure 44. The first enclosure 10 has an aperture 14 through one face into which projects an electrical connector 12 affixed rigidly to the first enclosure through bracket 16. The face of the first enclosure has four threaded holes 11 (only two being illustrated). The second enclosure 44 also includes an aperture 48 through its rear face into which projects electrical connector 46, which mates with connector 12 on the first enclosure.

As shown in FIGS. 4A, B and C, connector 12 may be subject to six degrees of of misalignment with respect to the first enclosure 10. This connector 12 may be translated with respect to the first enclosure along either the X or Y direction within the X-Y plane, which is defined to be coincident with the face of the first enclosure, or the connector 12 may be rotated within the X-Y plane ("roll"). In addition, the connector may be translated along the Z axis, or rotated out of the X-Y plane either along the Y axis, ("yaw") or the Z axis, ("pitch"). Any of these modes of misalignment or their combination can cause difficulty in mating connectors 12 and 46.

Figure 3:
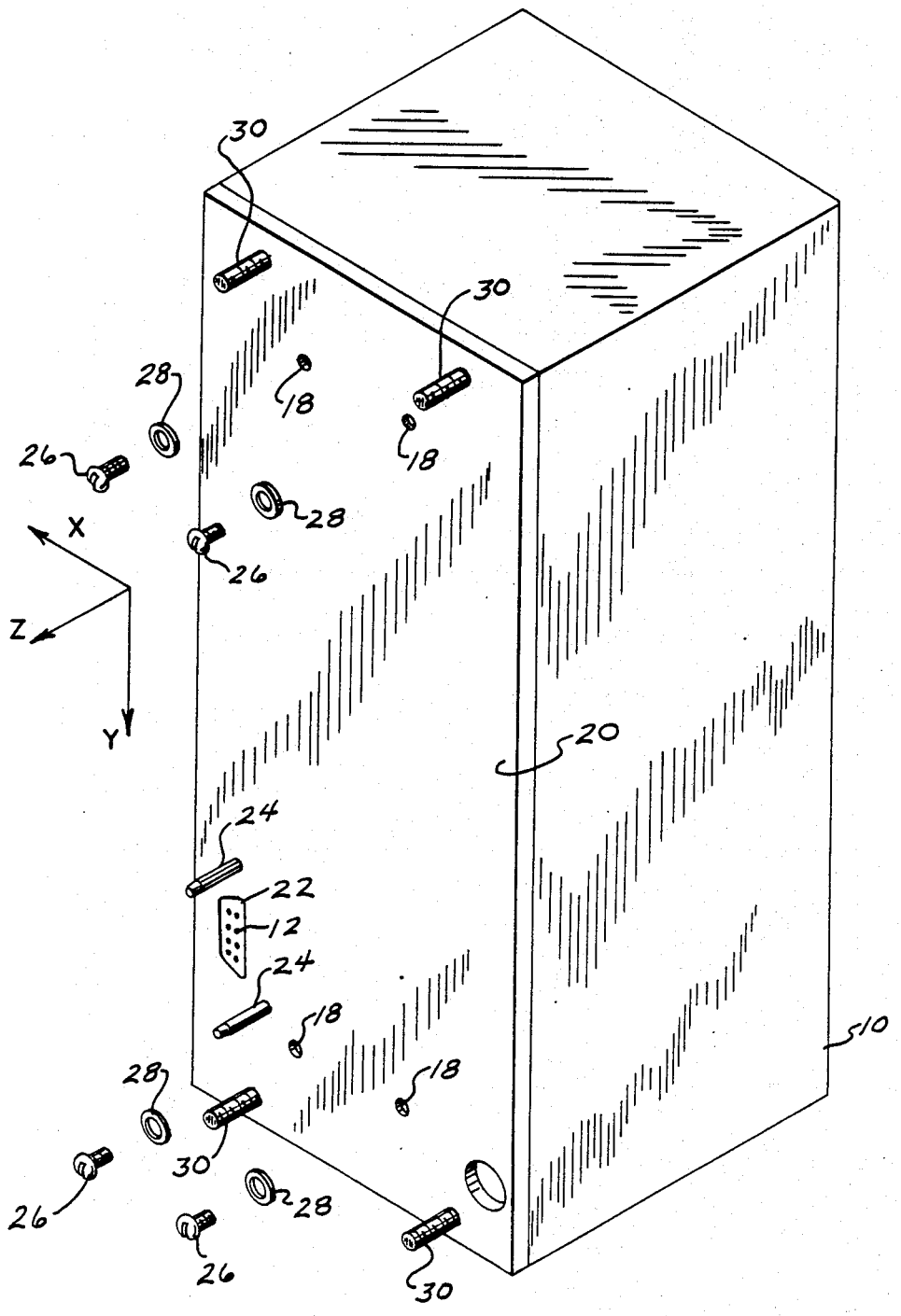
FIG. 3 is a perspective view of the intermediate guide plate oriented against a enclosure prior to assembly.

Referring to FIGS. 1 and 3, an intermediate guide plate 20 is placed against the front face of the first enclosure 10. The intermediate guide plate 20 has an aperture 22 of approximately the same dimension and relative location as aperture 14 on enclosure 10 to expose a portion of connector 12. Flanking aperture 22, and oriented along a line normal to the broad surface of intermediate guide plate 20, are two tapered guide pins 24 with their blunt ends affixed to the intermediate guide plate 20. Intermediate guide plate 20 also has four untapped holes 18 centered at approximately the same relative positions as holes 11 on the first enclosure. Four bolts 26 pass through washers 28, holes 18 and screw into holes 11 on the first enclosure so as to provide a means for holding intermediate guide plate 20 onto the first enclosure. Yet holes 18 are oversized to permit approximately 0.125 inches of motion in the X-Y plane, by the intermediate guide plate 20 with respect to the first enclosure, after bolts 26 are in place but prior to their tightening.

An alignment fixture 34, shown in FIG. 2, has holes 40 and 42 located to receive alignment pins 24. Hole 42 is elongated slightly (in the Y direction when positioned on the guide plate 20) to facilitate the fixture's placement and removal from pins 24 and to allow hole 40 to uniquely fix the position of the alignment fixture 42 with respect to the Y axis. Located accurately with respect to the holes 40 and 42 in the alignment fixture 34 is a connector housing 38 which mates with the first enclosure connector 12 to facilitate the correct positioning of the alignment pins 24 and the intermediate guide plate 20 with respect to connector 12. The connector housing 38 need not be an electrical connector but must be capable of securely engaging and positively locating connector 12. Handle 36 aids in positioning the alignment fixture 34. The alignment fixture 34 is placed over the pins 24 while the intermediate guide plate 20 is positioned against the enclosure 10. The engagement of the fixture 34 with the pins 24 on the intermediate guide plate and with the electrical connector 12 align these components. As mentioned, bolts 26 are inserted through holes 18 and screwed into holes 11. When alignment is complete, these bolts 26 are tightened and the alignment fixture 34 is removed.

Referring again to FIG. 1, a face of the second enclosure 44 is fitted against the intermediate guide plate 20 and thus against the face of the first enclosure 10 allowing the mating of connector 12 with connector 46. The intermediate guide plate 20 includes four externally threaded studs 30 which are received in holes 31 in the second enclosure 44 and fastened with nuts 32. The second enclosure 44 includes holes 52 and 54 in its face to accept alignment pins 24 and to ensure the alignment of connectors 12 and 46 by virtue of the intermediate guide plate 20 and alignment pins 24 positioned as described above. The holes 52 and 54 form a receptacle for the guide means provided by the pins 24. Hole 54 is also elongated in the manner of hole 42 described above.

FIG. 5 depicts connector 46 affixed to a printed circuit card 56 in the second enclosure 44 containing a slot 63 which partially separates a portion 58 of the printed circuit card containing the connector 46. The slot 63 cantilevers portion 58 of the printed circuit card 56 from the rest of the printed circuit card 56 allowing connector 46 to flex in the connector's yaw mode. The end of portion 58 remote from connector 46 is affixed to the second enclosure 44 by means of threaded stand-offs and screws 50. The opposite free end of portion 58 is supported by a spring loaded plunger comprising a piston member 60, coaxial with a spring 62 which presses the piston 60 against the free end of circuit card portion 58 reacting against support bracket 64 as shown in FIG. 1. The effect of this arrangement is to accommodate Z axis displacement and positive yaw of connectors 12 and 46.

It has been determined that the above described assembly method permits the connectors 12 and 46 to mate with misalignment of up to 0.125 inches in the X and Y axis, 0.062 inches in the Z axis, and up to 2° of roll or pitch and 4° of yaw.

Many modifications and variations of the preferred embodiment which will still be within the spirit and scope of the invention will be apparent to those of ordinary skill in the art. For example, the alignment plate may incorporate additional alignment pins or alignment pins of varying shape and location. Also, either connector 12 or 46 may be flexibly mounted on its printed circuit board as described. Thus the invention is not limited to the preferred embodiment but is defined by the claims which follow.

I claim:

1. A self aligning connector assembly comprising:

a first enclosure;

a first connector mounted to the first enclosure;

a guide plate including an alignment guide means affixed thereto and means which adjustably fasten the guide plate to the first enclosure so that the guide plate has a predetermined orientation with respect to the first connector;

a second enclosure including a receptacle for receiving the alignment guide means, and means for attaching the second enclosure to the guide plate; and a second connector mounted to the second enclosure and engaging the first connector;

whereby the first and second connectors are aligned with each other by means of the guide plate.

2. The self aligning connector assembly of claim 1 wherein the second enclosure includes a cantilevered circuit board attached thereto, and the second connector is mounted on the cantilevered circuit board.

3. The self aligning connector assembly of claim 2 further including a resilient support means coupling the cantilevered circuit board to the second enclosure.

4. The self aligning connector assembly of claim 3 wherein the resilient support means comprises a support bracket attached to the second enclosure, a plunger abutting the cantilevered circuit board, and a spring biasing the plunger with respect to the support bracket.

5. The self aligning connector assembly of claim 1 wherein the second enclosure includes a circuit board having one end portion fixedly attached to the second enclosure, and a resilient support means engaging the circuit board remote from the one end portion and coupled to the second enclosure, the second connector being mounted on the circuit board.

6. An alignment apparatus for a first enclosure having an electrical connector, comprising:

a guide plate including an alignment guide means affixed thereto and means to adjustably fasten the guide plate to the first enclosure so that the guide plate has a predetermined orientation with respect to the electrical connector, and including means for fixedly attaching a second enclosure to said guide plate; and a removable alignment fixture for temporarily engaging both the alignment guide means and the electrical connector to position the guide plate with respect to that electrical connector until the guide plate is fixedly attached to the first enclosure.

7. The apparatus as recited in claim 6 wherein the alignment guide means comprises a pair of tapered pins extending therefrom; and wherein the alignment fixture includes a pair of apertures which receive the tapered pins.

8. A method of electrically connecting a first enclosure having a first electrical connector to a second enclosure having a second electrical connector, comprising the steps of:

adjustably attaching a guide plate, having an alignment guide, to the first enclosure;

orienting the guide plate into a predetermined position with respect to the first electrical connector by engaging both the first electrical connector and the guide plate with an alignment fixture;

affixing the guide plate to the first enclosure;

removing the alignment fixture; and affixing the guide plate to a second enclosure with the second electrical connector coupled to the first electrical connector, the second enclosure having means which receive the alignment guide to thereby align the guide plate to the second enclosure.

* * * * *